US005836798A

United States Patent [19]

Dannoux et al.

[11] Patent Number: 5,836,798

[45] Date of Patent: Nov. 17, 1998

[54] METHOD OF MAKING A PLASMA DISPLAY PANEL

[75] Inventors: Thierry L. A. Dannoux, Avon; Bernard Eid, LaGrande-Paroisse; Jean M. M. G. Pegouret, Paris; Gilbert Dominique Pujol, Dammarie Les Lys, all of France

[73] Assignee: Corning Incorporated, Corning, N.Y.

[21] Appl. No.: 703,676

[22] Filed: Aug. 27, 1996

[51] Int. Cl.[6] ..... H01J 9/02

[52] U.S. Cl. ..... 445/24

[58] Field of Search ..... 445/24; 313/586

[56] References Cited

U.S. PATENT DOCUMENTS 5,736,815 4/1998 Amemiya ..... 313/586

FOREIGN PATENT DOCUMENTS

A-0554172 8/1993 European Pat. Off. .

A-2079045 1/1982 United Kingdom .

*Primary Examiner*—Kenneth J. Ramsey

*Attorney, Agent, or Firm*—Robert L. Carlson

[57] ABSTRACT

The panel has substrate (4) which has a network of barriers each incorporating electrode ($6_i$) of a first network of electrodes for control of the panel, a periodic arrangement ($R_i$, $V_i$, $B_i$) of areas of phosphorescent products being formed on substrate (4), transparent front plate (8), second network of electrodes ($10_j$) perpendicular to electrodes ($6_i$), an ionizable gas which is introduced between this substrate and this plate.

In order to manufacture substrate (4), one forms a metallic plate which has joined preforms of electrodes ($6_i$) of the first network, one covers the preforms with a layer of a dielectric material which is molded on it them and on the spaces separating them, and one removes the material from the metallic plate which joins the preforms of electrodes ($6_i$), so as to electrically insulate these electrodes from one another.

10 Claims, 2 Drawing Sheets

METHOD OF MAKING A PLASMA DISPLAY PANEL

FIELD OF THE INVENTION

The invention relates to a method of making a plasma display panel.

BACKGROUND OF THE INVENTION

The present invention concerns a process for the manufacture of a plasma display panel of the type which has: 1) a generally flat substrate which has a network of parallel straight barriers projecting from the middle plane of the substrate and each incorporating a first network of electrodes for control of the panel, a periodic arrangement of areas of phosphorescent products being formed between each pair of adjacent barriers, 2) a transparent front plate arranged facing the barriers of the substrate, 3) a second network of parallel and coplanar electrodes, which is perpendicular and adjacent to the electrodes of the first network in a plane parallel to the plane of this first network, 4) an ionizable gas which is introduced between this substrate and this plate.

Plasma panels of this type are described, for example, in U.S. Pat. No. 4,853,590 granted to Bell Communications Research Inc., as well as Japanese Patent application Nos. J04255638 in the name of NEC and J04075232 in the name of Dai Nippon Printing. The networks of parallel ribs or barriers mentioned above delimit between them columns of pixels which can be addressed independently in a mixture of rare gases of the Penning mixture type contained between this substrate and the front plate. The two perpendicular networks of electrodes allow one to ionize the gas in the selected pixels, the ultraviolet radiation emitted by the ionized gas causing the excitation of areas of phosphorescent products associated with said pixels, according to the configuration of an image which is to be displayed.

Plasma display panels are currently the object of numerous development efforts because they have particularly advantageous characteristics: large angle of observation, large format and flat shapes possible, high image definition possible, display without scintillation and a long service life. In particular, panels with electrodes carried on or embedded in the barriers of the substrate mentioned above allow one to obtain a high degree of brightness and particularly rapid addressing.

The manufacturing of such a panel has typically involved numerous steps: formation of the electrode networks by silk-screening or metal vapor deposition on a dielectric substrate such as glass, deposition and firing of dielectric frit, deposition of protective oxide such as MgO by evaporation under an electron beam, formation of barriers by superimposed multiple silk-screen impressions (as described, for example, in the aforementioned J04075232), deposition and firing of the phosphors.

This multiplicity of steps is obviously detrimental to the cost of manufacture of the panel. The manufacture of the barriers by superimposition of layers printed by silk-screening, in order to obtain barriers of sufficient height, does not allow one to obtain barriers with accurately defined sides. Furthermore, the aforementioned documents describe plasma display panels in which said barriers carry or incorporate electrodes. Such an arrangement allows one to improve the luminance and the yield of the panel, but its manufacture poses an additional problem of aligning the barriers and electrodes. The present invention therefore aims to provide a process for the manufacture of a plasma display panel which has none of the disadvantages mentioned above and which in particular allows for simpler and therefore less expensive industrial manufacturing, allowing one to obtain barriers with good geometry and which can be correctly registered with respect to the network of electrodes.

SUMMARY OF THE INVENTION

The present invention relates to a method of making an electrode/barrier rib structure for use in a plasma display, wherein a metallic plate is formed which has a base area and a plurality of electrode preforms on said base area. The electrode preform areas are covered with a layer of dielectric material, and the base area is removed, leaving metal electrodes which are partially encased in the dielectric material. In this way, the electrodes are electronically insulated from one another. The resulting structure can be used as an electrode structure, a barrier rib structure, or both, either or both of which may be employed as a back plate in a plasma display.

By depositing the dielectric material on the electrodes rather than the electrodes on such a material, in order to form the electrode barriers of the substrate, one eliminates the problems of registration of the prior art resulting from the formation of an electrode network on preformed barriers made of dielectric material. One simplifies and thus makes less expensive the industrial manufacture of a plasma display panel, while improving the quality of this manufacture.

The resulting electrode structure may then be used to form a plasma display.

Other characteristics and advantages of the process according to the invention will appear upon reading the description which follows and upon examination of the drawings.

DETAILED DESCRIPTION OF THE INVENTION

FIGS. 1A to 1F, which illustrate a process of manufacture according to the invention, are referred to in order. Thus, in accordance with the invention, a metallic plate 1 is formed which is generally flat and which has parallel ribs $\mathbf{2}_1$, $\mathbf{2}_2$, $\mathbf{2}_3$, etc., (see FIG. 1A), projecting from the surface thereof. These ribs can, for example, have a height of 180 $\mu$m, a thickness of 40 $\mu$m, and a pitch of 200 $\mu$m. These ribs constitute a first network of electrode preforms for a plasma display screen. It is possible to obtain such a plate by embossing a flat metallic plate between two rollers, one of which is etched or otherwise formed according to a geometry complementary to that desired on the plate 1. For reasons which will appear subsequently, one preferably uses a ductile metallic material having a thermal expansion coefficient close to that of glass (or approximately $80\times10^{-7}$/°C.); for example, the alloy Dilver P of the company Imphy S. A., alloys of iron, nickel, cobalt, or alloys of iron and nickel whose proportions allow one to adjust the thermal expansion coefficient; for example, the alloy N48 with a thermal expansion coefficient of $80\times10^{-7}$/°C.

Among the other possible processes for the manufacture of plate 1, it is possible to chemically etch plate 1 through one or more successive masks, in order to form the preforms 2.

Figure 1A:
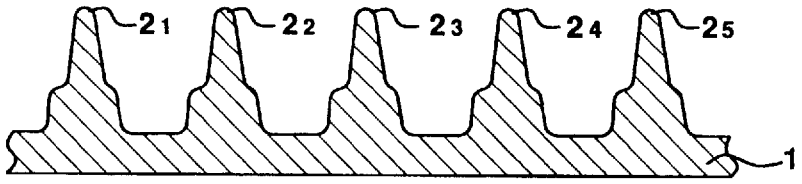
FIGS. 1A to 1F illustrate a method in accordance with the for making an electrode structure for a plasma display.
Figure 1B:
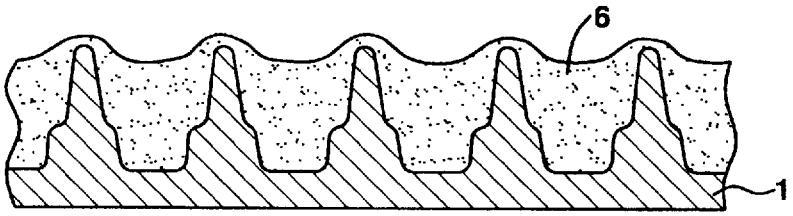
Figure 1C:
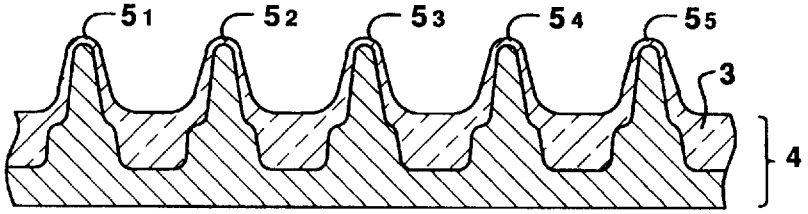
Figure 1D:
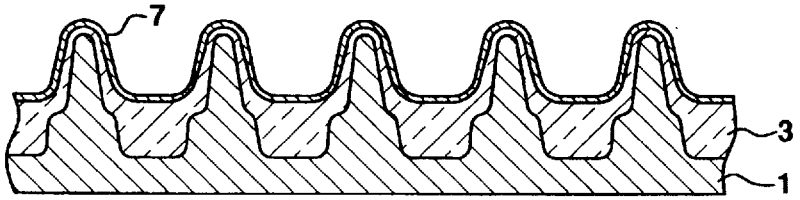
Figure 1E:
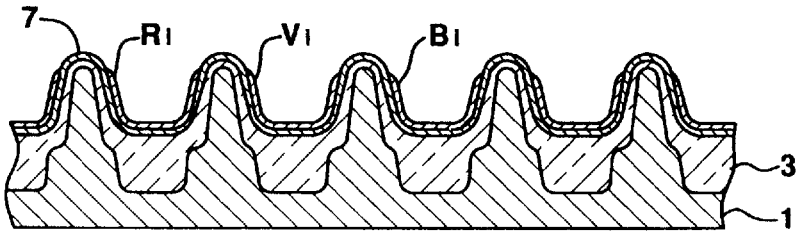

Once the plate of FIG. 1A is obtained, the preforms $\mathbf{2}_i$ are covered with a layer of dielectric material 3, both on top of the preforms 2 and in the recessed areas formed therebetween, as illustrated in FIG. 1C. After separation of the preforms, which will be described below, one thus immediately obtains substrate 4 which has barriers $\mathbf{5}_1$, $\mathbf{5}_2$, $\mathbf{5}_3$, etc., which project from the middle plane of the substrate and integral electrodes $\mathbf{6}_1$, $\mathbf{6}_2$, $\mathbf{6}_3$, etc., (see FIG. 1F ). By thus depositing a dielectric material on preformed metal rather than metal registered with a preformed dielectric substrate, as was done in the prior art, the invention makes it possible to eliminate the step of registration which is difficult and expensive to carry out precisely.

The deposition of a layer made of dielectric material on electrode preforms $\mathbf{2}_i$ is necessary, because in an alternating current plasma display panel (called AC-PDP following the English acronym) of the type considered here, the discharge current is limited by the thickness of this layer on the electrodes themselves, which is ordinarily from 15 to 25 $\mu$m.

The covering of metallic plate 1 with a dielectric material can be achieved by various techniques such as: scraping, curtain coating, electrostatic sputtering of the material, or else deposition, by silk-screening or by one of the aforementioned methods, of a glass frit, followed by its firing. As a nonlimiting example, a mode of implementation of this last technique will be described below. However, one could use a dielectric material other than glass in as much as it has suitable electrical and physicochemical characteristics.

A frit is formed by mixing glass powder having a low melting point (e.g., 450° to 500° C.) with a medium consisting of a binder (of the nitrocellulose or acrylic resin type) and a solvent (of the alcohol or ester type) so as to form a paste. The percentage of the glass powder in the mixture is preferably between 10 and 50 wt %, depending on the filling level desired in the spaces separating the barriers. Paste 6 (see FIG. 1B) is deposited with a scraper on plate 1 through a mask, for example, as is done ordinarily in silk-screening, in order to ensure the uniformity of the thickness of the layer of paste deposited. The paste is dried and cooked at 500° to 600° C. for approximately 30 minutes. The evaporation of the medium causes a reduction in volume of the paste. After its shrinkage, the glass covers barriers $\mathbf{2}_i$, as well as the bottom areas separating these barriers. One thus obtains substrate 4 of FIG. 1C.

Of course, the deposition of the frit on plate 1 could be done by other techniques such as, for example, mechanical or electrostatic sputtering of a suspension of the glass powder in a liquid, curtain coating, dipping, electrostatic sputtering of the dry glass powder.

According to the invention (see FIG. 1D), one then deposits, on the surface of glass layer 3 of substrate 4, layer 7 of magnesium oxide, MgO, which conventionally ensures the protection of this layer from deterioration which could otherwise result from the discharges in the gas which is contained between substrate 4 and the front plate, as will be seen below. The layer of MgO also lowers the discharge voltage of the gas. The deposition of layer 7 of magnesium oxide can be done, for example, by electron beam sputtering.

The next step (FIG. 1E) consists of depositing, on this layer, between barriers $\mathbf{5}_i$, phosphorescent products on areas consisting essentially of points grouped in repeated patterns such as triplets, ensuring under discharge emissions of red, green and blue light, for example, as is the case conventionally for the display of images in color. Thus, such pattern can contain, for example, three aligned adjacent areas $R_i$, $V_i$, $B_i$, each located between the barriers of three pairs of adjacent barriers. These areas can rise over the walls of barriers $\mathbf{5}_1$, as represented, in order to increase their surface area and therefore their light emission. The necessary phosphorescent products can be deposited by silk-screening, followed by firing, as described in EP-A 0 554 172, for example.

Figure 1F:
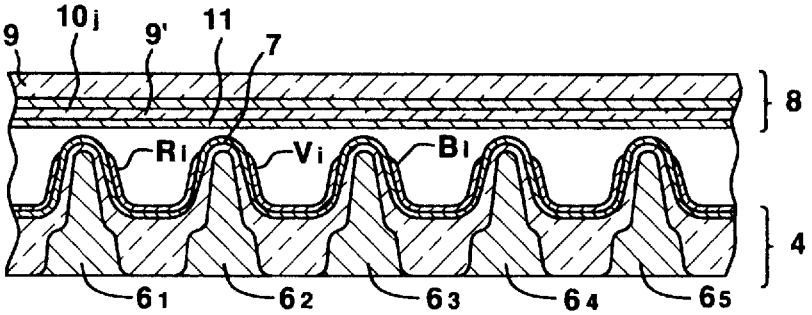

The base area of the metallic plate 1 is then removed, leaving only the electrodes $\mathbf{6}_i$, as illustrated in FIG. 1F. FIG. 1F also illustrates a plasma display assembly including an electrode structure in accordance with the invention. This assembly includes trans rent front plate 8 which carries a second network of electrodes $\mathbf{10}_j$ perpendicular to electrode $\mathbf{6}_i$.

A variety of methods may be employed to remove the base area of metallic plate 1 and thereby separate preforms $\mathbf{2}_i$, such as, for example, by mechanical abrasion and polishing, or by chemical etching and polishing, or a mixture of these and other techniques. One embodiment employs mechanically assisted chemical etching and polishing. In order to do this, one uses a polisher such as a rotary disk made of felt or a textile, fed by an etching solution loaded with an abrasive material. An aqueous solution of iron chloride loaded with particles of silicon carbide smaller than 20 $\mu$m is suitable. Monitoring of the progress of the polishing allows one to stop the etching of substrate 4 when the electrodes 6 are separated, as illustrated in FIG. 1F.

Front plate 8 consists of glass support 9, on which is formed a second network of electrodes $\mathbf{10}_j$, by silk-screening or deposition of a metal in vapor phase, for example. This network is protected by means of layer 9' of dielectric material, for example, a glass frit, and layer 11 of magnesium oxide, which are deposited as indicated in the preceding.

Plate 8 thus formed is superimposed on the substrate of FIG. 1F as represented in this figure. An annular seal (not shown) ensures the seal of the space between the plates. A mixture of rare gases of the Penning mixture type is then injected at a predetermined pressure into this enclosure. A matrix of discharge cells, corresponding to the number of pixels of an image to be displayed, is thus formed, each pixel being delimited by area $R_i$, $V_i$, $B_i$, of phosphors, framed by two adjacent electrodes $\mathbf{6}_i$ centered on electrode $\mathbf{10}_j$. Further on, in connection with FIG. 3, a process for control of the lighting of each pixel of panel 3 will be described.

Figure 2:
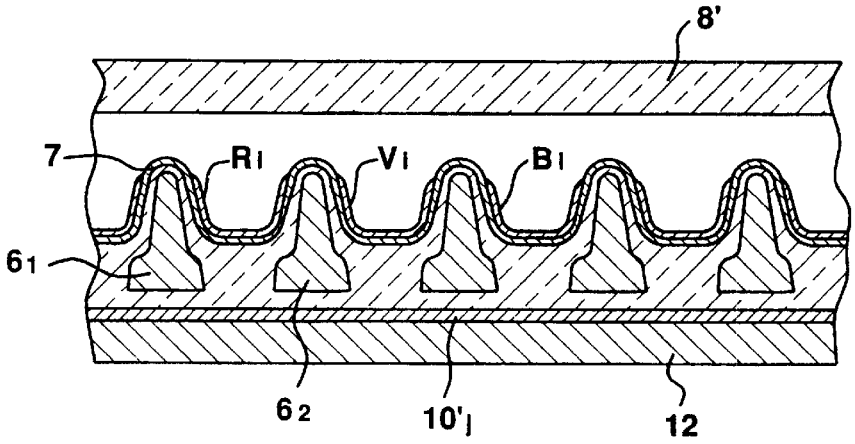
FIG. 2 is a cross section of a variation of the panel obtained by the process according to the invention.
Figure 3A:
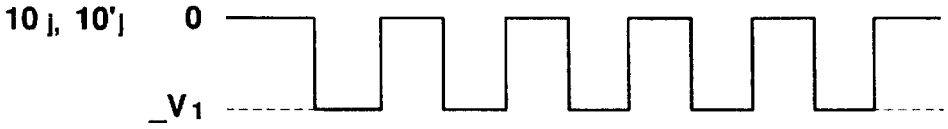
FIG. 3 is a timing diagram illustrating a process for control of addressing of the panel obtained by the process according to the invention.
Figure 3B:
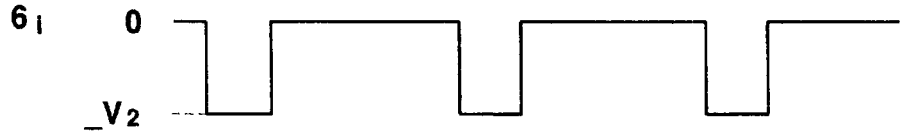
Figure 3C:
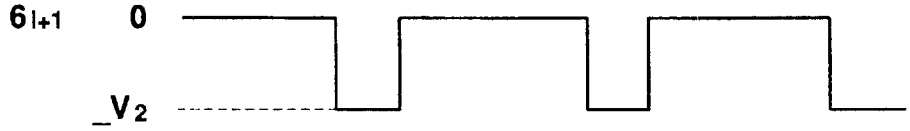
Figure 3D:
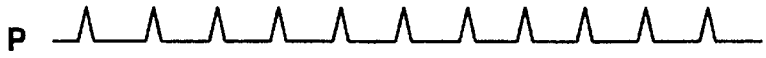

The process according to the invention also allows one to produce the panel represented in FIG. 2. The panel represented in this figure is distinguished from that of FIG. 1F in that second network of electrodes $\mathbf{10}_j$, perpendicular to electrodes $\mathbf{6}_i$, is formed on the same substrate as the latter electrodes and not on front plate 8', which is deposited with respect to the substrate in the same way as plate 8 of the panel of FIG. 1F.

In order to produce this variation, one covers bare electrodes $\mathbf{6}_i$ represented in FIG. 1F with a layer of glass in order to insulate them. This may be accomplished by depositing and firing a glass frit layer. One then forms by silk-screening or vapor metal deposition, a second network of electrodes $\mathbf{10'}_j$, over the layer of fired frit. The second network of electrodes is then covered with a suitable protective layer 12, as represented in FIG. 2. The assembling of the substrate thus formed with front plate 8', and the filling of the enclosure thus delimited are then done as described above.

In the case of the embodiment of FIG. 1F as well as that of FIG. 2, the networks of areas of phosphors formed on the substrate could consist of the same phosphor emitting a white light. In this case, the color of each pixel is supplied by the trichromatic network of triplets of colored filters formed on front plate 8, 8', on the side from which the displayed image is observed, these filters being centered in registration over the areas of phosphors formed on the substrate, in such a way that the light emitted by these areas passes through these filters.

FIG. 3 of the appended drawing will now be referred to in order to describe a process of addressing of a pixel of the panel, suitable for controlling the lighting of it or any other pixel, in accordance with an image to be displayed on this panel. As seen above, each pixel is defined $\mathbf{10}_j$, $\mathbf{10}_j$, of the second network, and two adjacent electrodes $\mathbf{6}_i$, $\mathbf{6}_{i+1}$ of the first network. The process described below applies to the embodiment of FIG. 1F as well as to that of FIG. 2.

One starts with a charge state of the pixel in consideration, resulting from a preceding precharge. The timing diagrams of FIG. 3 represent, in lines $\mathbf{10}_j$, $\mathbf{10'}_j$, $\mathbf{6}_1$, $\mathbf{6}_{i+1}$, the voltage controls of the corresponding electrodes, and in line P, the light emission of the pixel in question, which is not continuous, as appears in the figure. Each light pulse results from a discharge with a typical duration of a few hundred nsec, the frequency of these pulses being on the order of a few tens to a few hundreds of kHz. The three electrodes can be brought, during one period of this frequency, to a negative voltage $-V_1$ for electrode $\mathbf{10}_j$, $\mathbf{10'}_j$, $-V_2$ for electrodes $\mathbf{6}_i$, $\mathbf{6}_{i+1}$. At each instant, only one of the three electrodes is negative, which causes a discharge in the gas, either between electrodes $\mathbf{6}_i$, $\mathbf{10}_j$, or between electrodes $\mathbf{6}_{i+1}$, $\mathbf{10}_j$, $\mathbf{10'}_j$. The control frequency of electrode $\mathbf{10}_j$, $\mathbf{10'}_j$ is double that of electrodes $\mathbf{6}_i$, $\mathbf{6}_{i+1}$, With each discharge, a charge reversal between the bottom of area $R_i$, $V_i$, $B_i$ and one of the parts of this area rising over one of the barriers is seen, a discharge which causes the emission of light from the pixel at the aforementioned frequency, as represented in line P. It is possible to cause the initial lighting (the preceding precharge mentioned above) by applying a positive high voltage pulse to electrode $\mathbf{10}_j$, $\mathbf{10'}_j$ at the same time as the negative high voltage pulse −V2 to electrode $\mathbf{6}_i$, for example, of pair $\mathbf{6}_i$, $\mathbf{6}_{i+1}$. For more details concerning this process of addressing, one can refer to the aforementioned Japanese Patent Application No. J04075232.

In the embodiments of FIGS. 1F and 2, the areas of phosphors are formed on the substrate. Alternatively, these areas could be formed on front plate 8, 8', facing the substrate and between the pairs of adjacent barriers. They could also be formed both on the substrate and on the front plate.

The manufacturing process according to the invention has enabled one to produce substrate 4 with a thickness not exceeding 300 $\mu$m. It therefore allows one also to considerably reduce the thickness of the panel (ordinarily several mm in prior art) and therefore its weight. These advantages are added to those mentioned above in regard to quality and manufacturing cost.

Although the invention has been described in detail for the purpose of illustration, it is understood that such detail is solely for that purpose and variations can be made therein by those skilled in the art without departing from the spirit and scope of the invention which is defined by the following claims.

What is claimed is:

1. A method of making an electrode/barrier rib structure for a plasma display panel comprising:

forming a metallic plate comprising a base area and a plurality of electrode/barrier rib preforms on said base area;

covering the preforms with a layer of dielectric material; and removing said base area to form an electrode/barrier rib structure.

2. The method of claim 1, wherein the dielectric material used in said covering step is glass.

3. The method of claim 1, further comprising: depositing a layer of magnesium oxide on said dielectric material.

4. The method of claim 2, further comprising depositing pattern of phosphorescent material on said layer of magnesium oxide.

5. The method of claim 1, wherein said forming step comprises embossing said metallic plate to form said preforms.

6. The method of claim 1, wherein said forming step comprises chemically etching said metallic plate to form said preforms.

7. The method of claim 1, wherein said covering step comprises using a technique selected from the group consisting of: silk screening, doctor blading, curtain coating, and sputtering.

8. The method of claim 1, wherein said removing step comprises using a technique selected from the group consisting of: mechanical abrasion, chemical etching, and mechanically assisted chemical etching.

9. A method of making a plasma display, comprising combining an electrode/barrier rib structure made using the method of claim 1 with a transparent substrate to form a plasma display.

10. The method of claim 9, wherein said transparent substrate in said combining step comprises a network of electrodes thereon which is arranged orthoganally with said electrode/barrier ribs.

* * * * *